US005960854A

United States Patent [19]

Fink et al.

[11] Patent Number: 5,960,854

[45] Date of Patent: Oct. 5, 1999

[54] HOT CHAMBER DIE-CASTING MACHINE

[75] Inventors: Roland Fink, Winterbach; Ulrich Schraegle, Remshalden, both of Germany

[73] Assignee: Oskar Frech GmbH & Co., Schorndorf, Germany

[21] Appl. No.: 08/703,127

[22] Filed: Aug. 26, 1996

[30] Foreign Application Priority Data

Aug. 24, 1995 [DE] Germany ..... 195 31 161
Nov. 24, 1995 [DE] Germany ..... 195 43 805

[51] Int. Cl.[6] ..... B22D 17/02

[52] U.S. Cl. ..... 164/316; 222/593

[58] Field of Search ..... 064/316, 317, 064/318, 493, 513; 222/593

[56] References Cited

U.S. PATENT DOCUMENTS

| | | | |
|---|---|---|---|
| 2,004,959 | 6/1935 | Morin et al. | 164/316 X |
| 2,520,348 | 8/1950 | Tama | 164/316 X |
| 4,219,068 | 8/1980 | Greenwood | 164/316 |

FOREIGN PATENT DOCUMENTS

| | | | |
|---|---|---|---|
| 0 662 361 | 7/1995 | European Pat. Off. . | |
| 18 78 490 | 1/1963 | Germany . | |
| 21 41 551 | 4/1972 | Germany . | |
| 21 55 648 | 5/1972 | Germany . | |
| 24 25 067 | 12/1975 | Germany . | |
| 438781 | 11/1935 | United Kingdom | 164/316 |

OTHER PUBLICATIONS

*Giesserei–Praxis* 1982, pp. 127–133 entitled Entwicklungen bei der Formkonstruktion für Magnesium–Warmkammer–Druckguss by D.B. Mulls.

E. Brunhuber, Praxis der Druckguss fertigung, 1981, pp. 41–45 and 202–206.

*Primary Examiner*—J. Reed Batten, Jr.

*Attorney, Agent, or Firm*—Evenson, McKeown, Edwards & Lenahan, P.L.L.C.

[57] ABSTRACT

In a hot chamber die-casting machine, inductively-operating heating devices are associated with the mouthpiece area of the casting container and the nozzle. All of these heating devices are operated with medium frequency. The inductors are cooled with air. The machine is useful for hot chamber die-casting machines that process magnesium.

26 Claims, 5 Drawing Sheets

HOT CHAMBER DIE-CASTING MACHINE

BACKGROUND AND SUMMARY OF THE INVENTION

The invention relates to a hot chamber die-casting machine for processing magnesium melts, with a casting container, a riser tube having a conical mouthpiece and a nozzle mounted on the mouthpiece, and a heating device for heating the nozzle and the mouthpiece area of the casting container.

In the hot chamber die-casting process, the casting container and the casting piston of the casting unit are located in liquid metal. As a result, the economy of the hot chamber process is much higher than in the cold chamber process.

It is also known that the material, magnesium, is easy to cast and is attractive for many applications because of its low weight. The processing temperature of magnesium, however, is between 630° C. and 660° C., depending on the alloy. Owing to this high temperature, it is necessary in hot chamber die-casting machines of the type mentioned above to provide heating, for the nozzle and the casting container. It is known that gas heat can be used to heat the nozzle and the casting container extension. This has certain disadvantages, however. Firstly, an open gas flame is present which must be monitored for safety reasons. It is also difficult to heat the nozzle with a constant temperature. This can result in deformation, especially bending of the nozzle. Heating with a gas flame can also result in decarburization of the very expensive material of which the nozzle and casting container are made. Therefore, a temperature control is required for the nozzle and casting container in order not to unnecessarily shorten the lifetime of the parts subject to wear. Open flames are especially undesirable when processing magnesium, for safety reasons.

Although heating systems have already been proposed that provide inductive high-frequency heating in the vicinity of the nozzle, in these proposals the extension of the casting container for the nozzle system is heated with gas. The above-mentioned disadvantages are then associated with gas heating employed in this manner. Since the inductors must be cooled with water in high-frequency heating, there is also a risk that water and magnesium will react with one another in an undesirable manner.

The goal of the present invention is therefore to propose a heating system for processing magnesium melts in a hot chamber die-casting machine that allows simple temperature monitoring and permits the desired high temperatures to be reached without adversely affecting safety.

To achieve this goal, in a hot chamber die-casting machine of the type mentioned above, provision is made such that an inductively-operating heating device is associated with the mouthpiece area of the casting container and the nozzle. All heating devices are operated at medium frequency (a frequency at the lower limit of high frequency), and the inductors are air-cooled. Hence, the invention is based on the idea that even relatively low frequencies are sufficient to generate the necessary heat and that lower cooling power, provided -by air, can suffice. The danger that water and magnesium will react with one another is thus reliably ruled out. Inductive heating makes it possible, in a relatively simple fashion, to achieve and perform uniform heating of the nozzle and casting container extension under temperature control. The operating frequencies for the heating device are of an order of magnitude between 8 kHz and 15 kHz.

In a preferred embodiment of the invention, the inductors can consist of helically wound, externally insulated copper tubes that are energized with electrical current and traversed by air. This design permits relatively simple manufacture of induction heating. An air inlet valve can be provided at one end of the copper tube while an air outlet valve is provided at the other end, with the latter opening more or less under temperature control, so that controlled air cooling of the inductors can be effected in a relatively simple fashion.

In a further preferred embodiment of the invention, the copper tube can be wound to form sleeve bodies that can then be slid in multiples onto cylindrical parts of the device to be heated. Thus, in an improvement on this idea, a sleeve body is pushed onto a cylindrical extension of the casting container in the vicinity of the mouthpiece, onto the area of the cylindrical nozzle adjacent to this casting container area, and onto the nozzle in the vicinity of its mouthpiece.

In yet another preferred embodiment of the invention, the sleeve body pushed onto the casting container extension can project externally beyond this extension, and surround externally at least the connecting area of the nozzle. In order to be able to detect any leaks, in an improvement on the invention, a monitoring unit for blooming magnesium oxide can be provided within the sleeve body projecting from the casting container and between the latter and the nozzle. The monitoring unit advantageously is designed as a ring with a contact loop. Although continuous heating is then provided from the casting container up to the nozzle mouthpiece, the risk of leaks in the nozzle assembly not being noticed and magnesium escaping are largely eliminated.

However, to make the seal as good as possible, in an advantageous embodiment, the conical connecting area of the nozzle can be provided with an O-ring for sealing in the vicinity of the conical mouthpiece of the casting container, and a sealing cord tensioned between two flange rings can be provided to seal the casting container cover off from the part of the casting container that projects from the latter, i.e. below the cylindrical extension. These measures contribute to the safety of the inductively heated casting unit.

In order to prevent any magnesium that might possibly spray out from penetrating into the vicinity of the inductors during the casting process, provision can be made such that at least the inductor associated with the nozzle is provided at its end facing the casting container with an edge that overlaps the forward edge of the inductor that extends to the mouthpiece area. By this means, any magnesium possibly spraying backward during the die-casting process can be reliably prevented from penetrating into the area between or under the inductors. In a preferred embodiment of the present invention, the inductor associated with the nozzle can also have a conical external contour that deflects any magnesium spraying rearward, forcibly outward.

In a preferred embodiment of the invention, the inductor extending to the mouthpiece area can be provided with an edge that overlaps the forward end of the inductor that rests on the cylindrical extension of the mouthpiece area. This edge can thus be formed in simple fashion by a flange provided with an annular surface extending diagonally in the direction of the forward end of the nozzle and up to the cylindrical area of the inductor. This annular surface also serves as a deflector for any spraying magnesium.

In another advantageous embodiment of the invention, an annular inductor can be provided in the vicinity of the crucible cover, said inductor being placed around the casting container to keep the temperature uniform and to make the method safer.

Other objects, advantages and novel features of the present invention will become apparent from the following detailed description of the invention when considered in conjunction with the accompanying drawings.

DETAILED DESCRIPTION OF THE DRAWINGS

Figure 1:
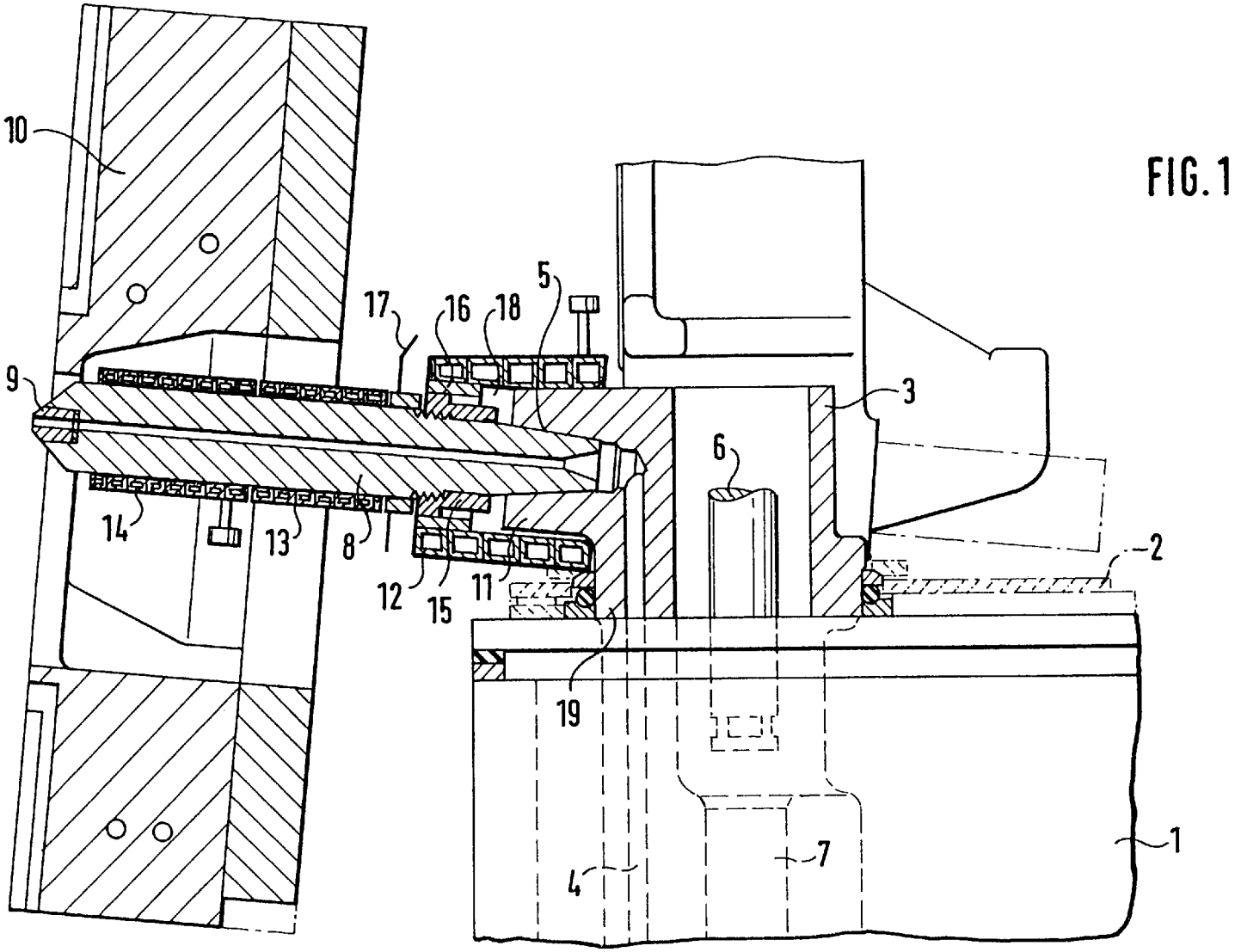
FIG. 1 is a schematic section view through the outlet area of a hot chamber die-casting machine according to the invention.

FIG. 1 shows a portion of a hot chamber die-casting machine used for processing magnesium. The liquid magnesium is at temperatures of approximately 630–680° C. inside container (1) not shown in greater detail. A casting container (3) projects into this container (1) through a cover (2). The casting container (2) has a riser bore (4) with a conical mouthpiece (5). In casting container (3), there is also a casting piston, not shown in greater detail. The piston is guided into casting cylinder (7) from above by piston rod (6) in a known fashion. The cylinder (7) is filled from liquid container (1) with the volume of liquid to be poured, before the piston closes off the filling opening by its motion, forcing the liquid metal upward through riser bore (4).

A nozzle (8) is inserted into mouthpiece (5) of casting container (3). The nozzle extends with its mouthpiece (9) into the casting area of mold (10), with the latter indicated only schematically.

According to the invention, a sleeve-shaped inductive heating body (12) is slid onto the approximately cylindrical extension (11) of casting container (3). Two additional sleeve-shaped inductive heating bodies (13 and 14) are slid onto the middle area of nozzle (8) and onto the area of mouthpiece (9) of nozzle (8). This can be accomplished by sleeve body (12) being slid on even before nozzle (8) is mounted, with nozzle (8) then being inserted into conical connecting opening (5), and the two sleeve bodies (13 and 14) then being pushed onto the nozzle (8). Separate mounting is not necessary, because sleeve bodies (13 and 14) are held automatically by virtue of the slightly diagonal position of nozzle (8), and sleeve body (12) likewise holds onto the slightly diagonal extension (11) without any special fastening means. Since they are not fastened, all heating bodies 12, 13, 14) can be shifted very easily by hand in order-to thus obtain the optimal temperature in the corresponding areas.

Sleeve body (12) is placed on extension (11) in such fashion that it projects outward over the end of the extension (11). Sleeve body (12) also extends beyond a nut (15) screwed onto nozzle (8) for later disassembly of nozzle (8), as well as a monitoring device located on the inside of sleeve body (12) in the form of a ring (16) provided with a contact loop. A protective sheet (17) is located in front of the end of sleeve body (12), facing mouthpiece (9) of nozzle (8). The sheet is intended to prevent undesired penetration of any magnesium melt that might spray backward.

Monitoring device (16) in the embodiment serves to catch any magnesium blooms in cavity (18) between sleeve body (12) and nozzle (8) that might develop, for example as the result of a leak between extension (11) and nozzle (8) or as a result of leaks in the vicinity of neck (19) of casting container (3) such that the magnesium that would then penetrate into the area within sleeve body (12).

Figure 2:
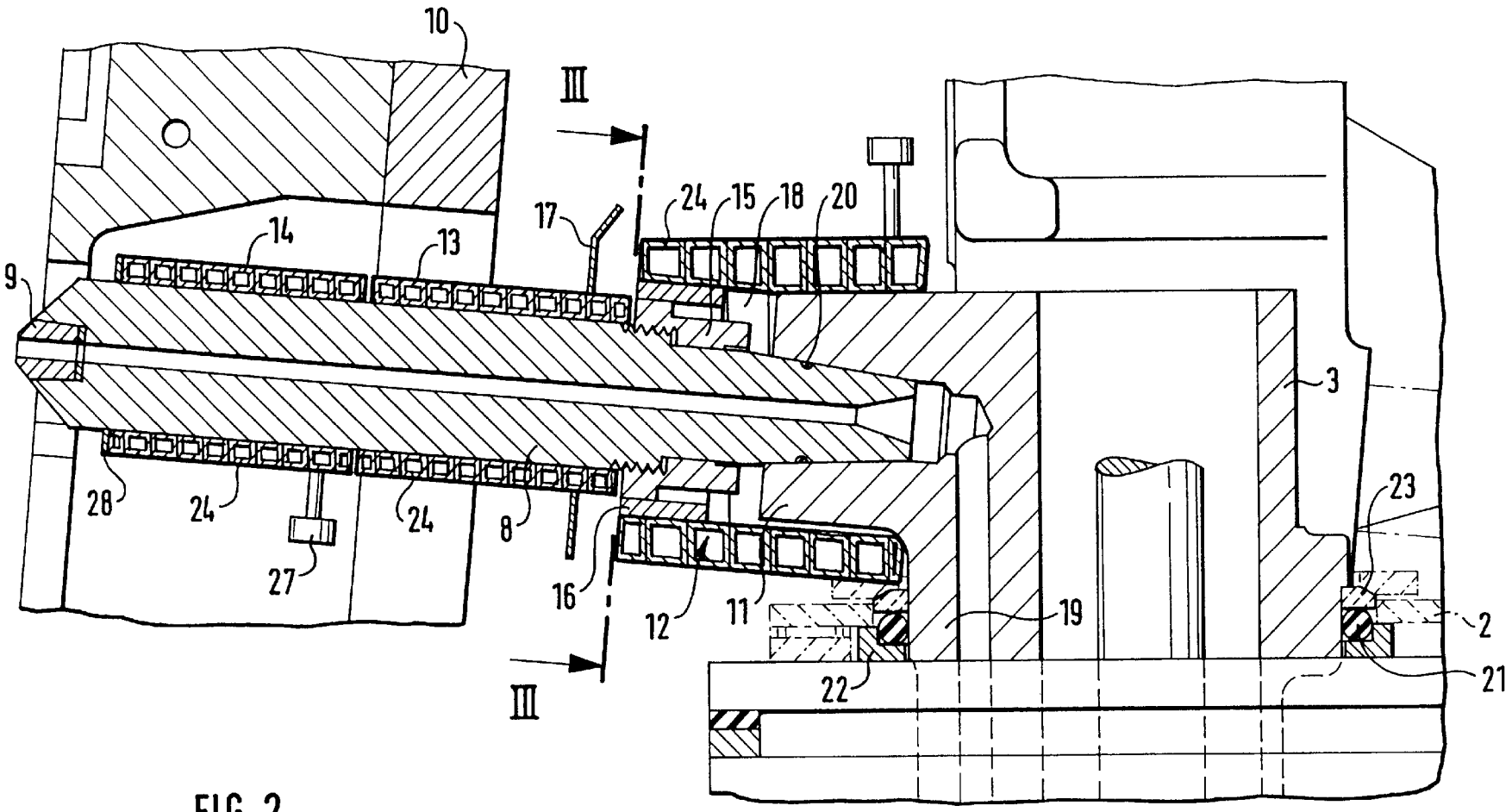
FIG. 2 is an enlarged view of the area in FIG. 1 of the inserted and sealed nozzle with heating according to the invention.

FIG. 2 shows that an O-ring (20) has been placed on the conical area of nozzle (8) for a better seal between extension (11) of casting container (3) and nozzle (8). A circumferential sealing cord (21) is provided in the vicinity of neck (19) of casting container (3). The cord (21) is clamped between two flange rings (22 and 23), thus providing the required seal between cover (2) for the metal melt and neck (19) of casting container (3). Flange ring (22) is thus permanently welded to cover (2). Flange ring (23) is made of asbestos-free ceramic material. This ensures that the inductive field is not disturbed. The heating effect can thus be utilized optimally.

Figure 3:
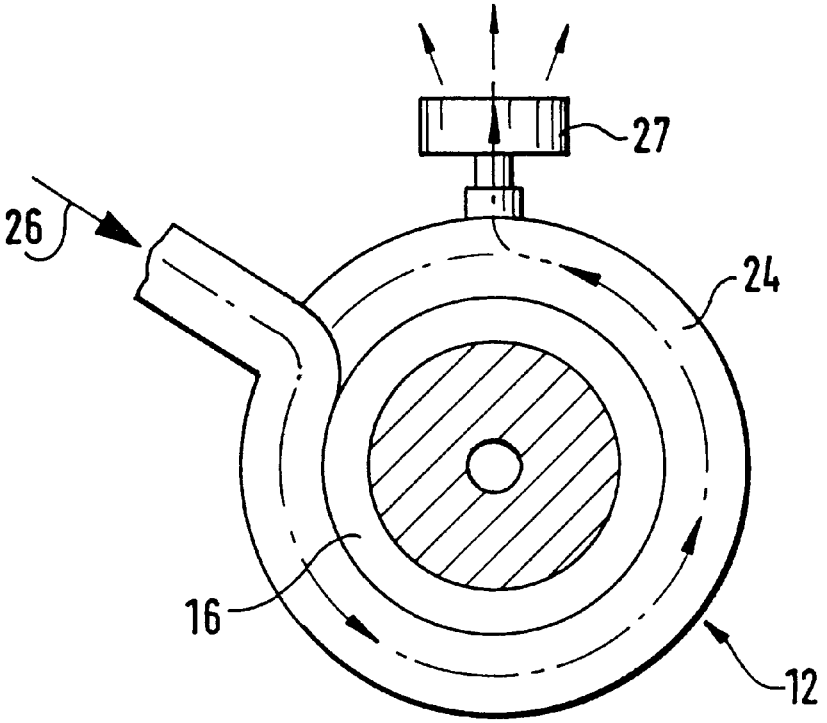
FIG. 3 is a schematic end view of the heating device associated with the mounting area of the nozzle and casting container.
Figure 4:
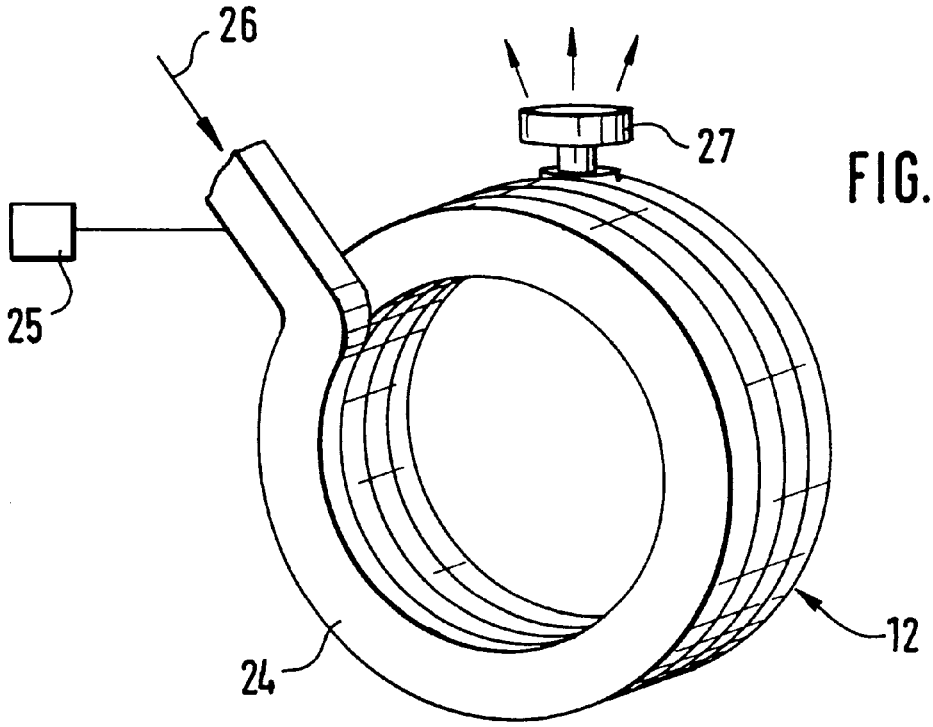
FIG. 4 is a schematic perspective view of the structure of the inductors provided for heating.

FIGS. 3 and 4, together with FIG. 2, show that sleeve bodies (12, 13, and 14) are made of inductors each of which is composed of helically wound and externally insulated copper tubes (24) to which, as shown schematically in FIG. 4, the frequency required by a corresponding generator (25) to generate the alternating magnetic field is applied, as well as charging with air in the direction of arrow (26). The air supplied in the direction of arrow (26) serves as cooling air for the inductors. It escapes again through an outlet valve (27) that opens or closes under temperature control. As the temperature increases, determined by a sensor, valve (27) opens more and more, so that when tubes (24) become too hot during operation, improved cooling is provided by more air flowing through.

FIG. 4 shows that copper tubes (24) can simply be wound into sleeve bodies (12, 13, and 14). Of course, the inductors thus formed, which can be air-cooled, are provided externally with thermal insulation before they are pushed into their corresponding mounting positions.

The end of sleeve body (14) facing mouthpiece (9) is likewise provided with a protective sheet (28) The inductors are supplied by generator (25) with a type of medium frequency, i.e. with a frequency between 8 kHz and 15 kHz. When the inductors are operated at these frequencies, air cooling is possible, due mainly to the special design of the inductors. As a result of these measures, there is no risk of cooling water coming in contact with escaping magnesium. A reaction between magnesium and water is therefore eliminated. The arrangement of monitoring device (16) in turn ensures that cavity (18), which cannot be seen during operation, can be reliably monitored.

To remove nozzle (8), sleeve bodies (14 and 13) are pulled downward and forward from nozzle (8) after the machine is shut off. This can be accomplished simply by hand. Then sleeve body (12) is pulled down from extension (11), which can also be done by hand, so that nozzle (8) can then be removed in known fashion by operating push-off nut (15). This design however also makes it possible, during a brief shutdown of the machine for example, to pull front sleeve body (14) when withdrawn over the tip of the nozzle, so that when the machine starts, the correct temperature will be reached immediately at the nozzle tip for the first shot.

Figure 5:
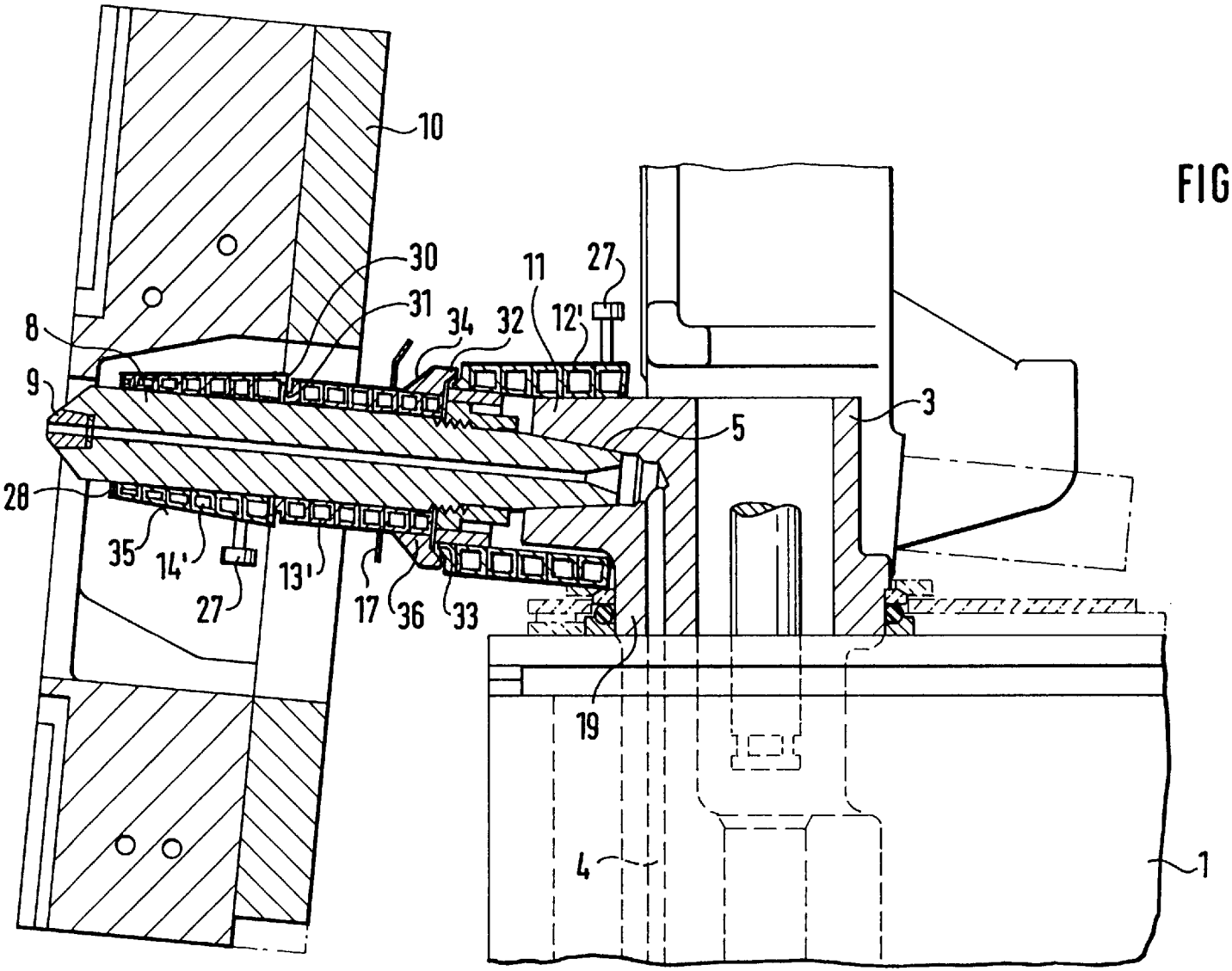
FIG. 5 is an enlarged view of the area of the mounted and sealed nozzle with the heating according to the invention, similar to FIG. 2.

In contrast to the design shown in FIGS. 1 and 2, FIG. 5 indicates that inductor (14'), pushed onto the area of mouthpiece (9) of nozzle (8) and also having the same design as the inductors explained in reference to FIGS. 3 and 4, has a conical outer contour (35) that serves during the die-casting process to deflect outward any magnesium that sprays out between mouthpiece (9) and the workpiece, keeping it away from the vicinity of the adjacent inductor (13') and inductor (12') mounted on mouthpiece (11) of casting container (3). This purpose is also served by the fact that the end of inductor (14') facing the casting container and having the larger diameter has a projecting circumferential edge (30) that overlaps an extension (31) at the forward end of inductor (13'). As a result of this overlap, a seal is created between the adjoining inductors which likewise reliably prevents magnesium from penetrating the area between inductors (13' and 14') or the area between the inductors and nozzle (8).

Inductor (13') in turn is provided with a flange (36) at its end facing casting container (3), said flange being provided with a diagonally extending annular surface (34) facing the cylindrical outer circumference and forward end of nozzle (8). The annular surface also serves as a deflecting surface for any magnesium that sprays out. This flange (36) is provided on the side facing inductor (12') with a circumferential edge (32) that overlaps a recess (33) of inductor (12'), so that a seal between the inductors is created at this point as well.

Otherwise, the design of the hot chamber die-casting machine according to FIG. 5 corresponds to the design of the die-casting machine described with reference to FIG. 2.

Figure 6:
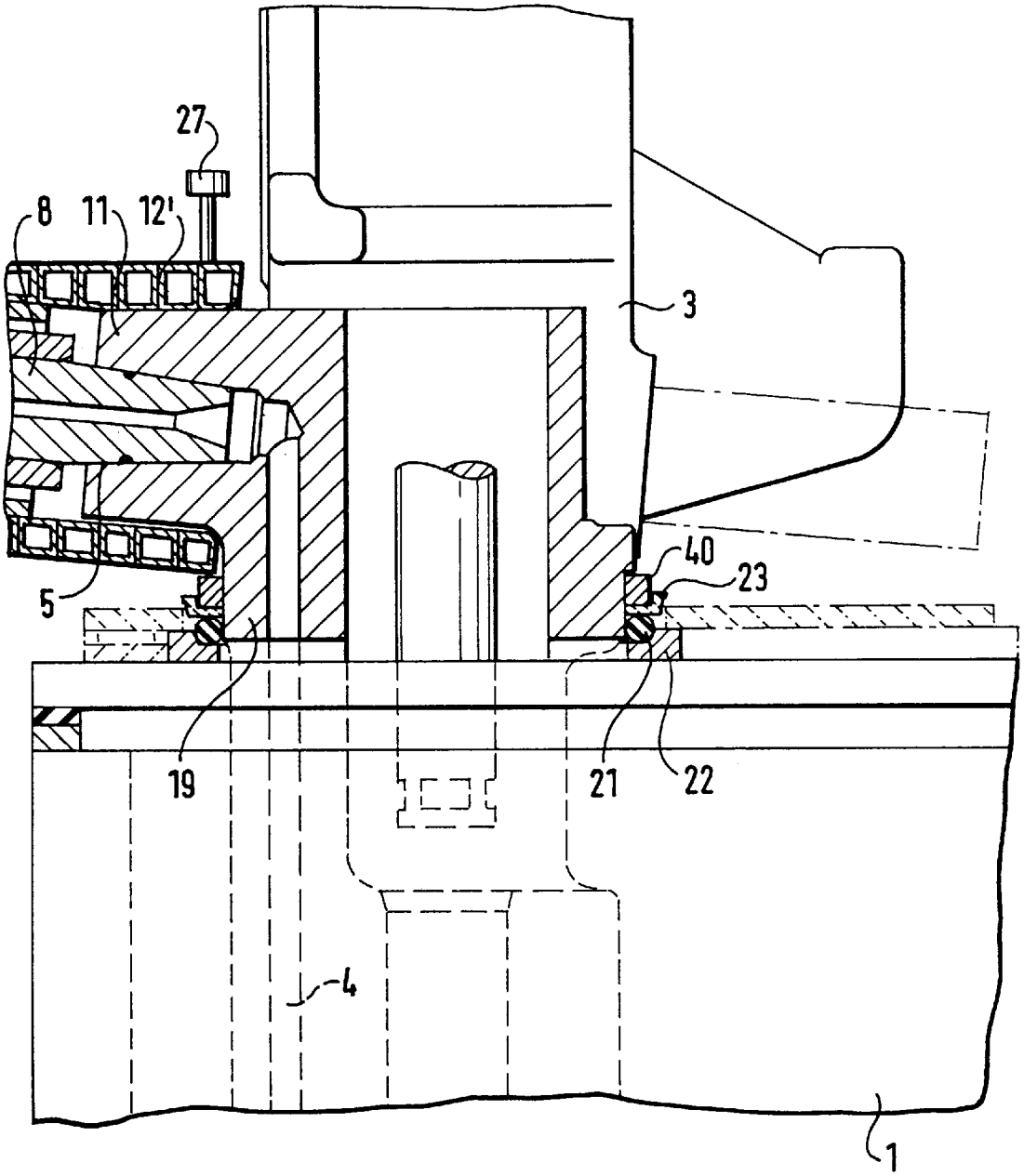
FIG. 6 shows the vicinity of the crucible cover with an additional annular inductor placed around the casting container.

In the embodiment shown in FIG. 6, in the vicinity of cover (2) of container (1) for the melt, an annular inductor (40) is placed above gasket (21) and around the neck of casting container (3). This annular inductor (40) can likewise be designed like the inductors already described. It is operated at medium frequency.

Annular inductor (40) can be made in one piece and is then pushed axially over the neck of casting container (3). However, it is also possible to make annular inductor (40) out of two half shells, each of which is fitted externally onto the outside of the neck of the casting container, and the two are then joined with one another.

This annular inductor (40) serves to produce a temperature distribution on the neck of casting container (3) that is as constant as possible. The safety of the casting method can be ensured thereby.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Hot chamber die-casting machine for processing magnesium melts, comprising:

a casting container having a riser bore with a conical mouthpiece;

a nozzle mounted on the mouthpiece;

a heating device for heating said nozzle;

wherein said heating device is at least one inductively-operating heating device having an inductor mounted in a mouthpiece area of the casting container and the nozzle, said at least one inductively-operating heating device being operated with a medium frequency; and wherein the inductor comprises tubing through which an air stream is guided for air-cooling the inductor.

2. The hot chamber die-casting machine according to claim 1, wherein said medium frequency includes a frequency which is at a lower limit of a high frequency range.

3. The hot chamber die-casting machine according to claim 1, wherein the operating frequency of the heating device is between 10 kHz and 15 kHz.

4. The hot chamber die-casting machine according to claim 1, wherein the inductor includes helically wound, externally insulated copper tubing, said tubing being energized with the operating frequency.

5. The hot chamber die-casting machine according to claim 3, wherein the inductor includes helically wound, externally insulated copper tubing, said tubing being energized with the operating frequency.

6. The hot chamber die-casting machine according to claim 4, wherein an air inlet is provided at one end of the copper tubing and an outlet valve is provided at the other end, said outlet valve opening to a greater or lesser degree depending on temperature.

7. The hot chamber die-casting machine according to claim 4, wherein the copper tubing is wound to form a sleeve body.

8. The hot chamber die-casting machine according to claim 7, wherein several sleeve bodies are provided, each of which is pushed onto an extension that is cylindrical in a vicinity of the mouthpiece of the casting container, into the area of the nozzle adjoining this casting container area, and onto the nozzle in the vicinity of the mouthpiece.

9. The hot chamber die-casting machine according to claim 8, wherein one of said several sleeve bodies pushed onto the casting container extension projects externally beyond the extension, and surrounds externally at least a connecting area of the nozzle.

10. The hot chamber die-casting machine according to claim 8, wherein said sleeve bodies are adjustable to various areas by manual displacement.

11. The hot chamber die-casting machine according to claim 8, wherein first and second protective sheets are provided on a first of said several sleeve bodies placed on the casting container extension in front of the end face pointing away from the casting container, and on the outer end of a second of said several sleeve bodies pushed onto the mouthpiece of the nozzle, respectively.

12. The hot chamber die-casting machine according to claim 9, further comprising:

a monitoring unit for magnesium oxide blooms arranged inside said one sleeve body, projecting from the extension and between the latter and the nozzle.

13. The hot chamber die-casting machine according to claim 12, wherein the monitoring unit is designed as a ring with a contact loop, fastened on said one sleeve body.

14. The hot chamber die-casting machine according to claim 8, wherein a conical connecting area of the nozzle is provided with an O-ring for sealing in the area of the conical mouthpiece of the casting container.

15. The hot chamber die-casting machine according to claim 8, wherein a sealing cord tensioned between two flange rings is provided for sealing the casting container cover off from a neck of the casting container that projects out of said cover.

16. The hot chamber die-casting machine according to claim 15, wherein one of said two flange rings is permanently welded to the cover.

17. The hot chamber die-casting machine according to claim 15, wherein one of said two flange rings is formed of an asbestos-free ceramic material.

18. The hot chamber die-casting machine according to claim 16, wherein another of said two flange rings is formed of an asbestos-free ceramic material.

19. The hot chamber die-casting machine according to claim 1, wherein at least one inductor associated with the nozzle is provided at its end facing the casting container with an edge that overlaps a forward end of another inductor that extends to said mouthpiece area.

20. The hot chamber die-casting machine according to claim 19, wherein said at least one inductor associated with the nozzle has a conical outer contour.

21. The hot chamber die-casting machine according to claim 18, wherein said another inductor that extends toward the mouthpiece area is provided with an edge that overlaps a forward end of a further inductor that rests on a cylindrical extension of the mouthpiece area.

22. The hot chamber die-casting machine according to claim 21, wherein said edge projects from a flange, said flange being provided with an annular surface that extends diagonally in the direction of the forward end of the nozzle and into the cylindrical area of the further inductor.

23. The hot chamber die-casting machine according to claim 1, wherein an additional annular inductor is placed around the casting container in a plane of the cover of the container for the melt.

24. The hot chamber die-casting machine according to claim 23, wherein said additional annular inductor is composed of half-shells that are fitted onto a neck of the casting container.

25. A heating system for processing melts in a hot chamber die-casting machine having a conical mouthpiece formed in an extension area of a casting container and a nozzle mounted on said conical mouthpiece, the heating system comprising:

at least one inductive heating body having a sleeve-shape adapted to a particular shape of said extension area, said at least one inductive heating body comprising tubing through which an air stream is guided for air-cooling the inductive heating body;

a generator coupled to said at least one inductive heating body for applying an operating frequency to the heating body, said operating frequency being a medium frequency; and whereby said at least one inductive heating body is fitted over the extension area to inductively heat the extension area.

26. The heating system according to claim 25, further comprising additional inductive heating bodies, one of said additional inductive heating bodies being adapted to slide onto a middle area of said nozzle and a further one of said additional sleeve bodies being adapted to slide over a mouthpiece area of said nozzle.

* * * * *